US006208831B1

(12) United States Patent
Amano

(10) Patent No.: US 6,208,831 B1
(45) Date of Patent: Mar. 27, 2001

(54) MOUNTING DEVICE FOR IMAGE FORMING APPARATUS

(75) Inventor: Toshiaki Amano, Chigasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/506,926

(22) Filed: Feb. 18, 2000

(51) Int. Cl.[7] ..... G03G 15/00
(52) U.S. Cl. ..... 399/396; 399/391; 271/270
(58) Field of Search ..... 399/396, 391, 399/393; 271/270

(56) References Cited

U.S. PATENT DOCUMENTS 5,186,449 * 2/1993 Ohmi et al. ..... 271/10
5,255,904 * 10/1993 Taguchi et al. ..... 271/18.1
5,602,571 * 2/1997 Suda et al. ..... 346/134
5,689,760 * 11/1997 Suzuki et al. ..... 399/45
5,924,686 * 7/1999 Jacobson et al. ..... 271/3.17

FOREIGN PATENT DOCUMENTS 62-36939 8/1987 (JP) .

* cited by examiner

*Primary Examiner*—Richard Moses
(74) *Attorney, Agent, or Firm*—Foley & Lardner

(57) ABSTRACT

A mounting device for an image forming apparatus comprises a mounting rack for mounting an image forming apparatus for forming an image at a predetermined speed, a feeding section provided within the mounting rack for feeding a medium into the image forming apparatus, and a changing section for changing a medium feeding speed of the feeding section in accordance with an image forming speed of the image forming apparatus. The changing section comprises a movable gear having coaxially-arranged large and small gear portions different in the number of teeth and rotating upon receipt of driving force, and first and second power transmitting sections for transmitting power to the feeding section when the large and small gear portions are selectively connected by shifting the movable gear, to thereby drive the feeding means at a different speed.

7 Claims, 9 Drawing Sheets

MOUNTING DEVICE FOR IMAGE FORMING APPARATUS

BACKGROUND OF THE INVENTION

The present invention relates to a mounting device for mounting an image forming apparatus such as an electrographic color copying machine or a color printer.

The mounting device of this type has a paper feed function, so that a plurality of types of paper sheets can be fed into an image forming apparatus (hereinafter the mounting device will be referred to as a "paper feed rack"). In some of the paper feed racks, a paper feed speed can be changed in accordance with a copying speed of the image forming apparatus, that is, a paper transfer speed.

Methods for changing the paper transfer speed include a method of exchanging a drive gear with a gear having a different number of teeth or a method of controlling a rotation number of a drive motor. Furthermore, a method is known using two electro-magnetic clutches different in the number of teeth. In this method, one of the two electromagnetic clutches is regularly connected and the other is connected at occasions when the speed is required to be changed.

However, in the method of exchanging the drive gear, a service technician has to disassemble the machine more or less. Therefore, time and labor are required.

In the method of controlling the rotation number of the drive motor, if the paper transfer speed is changed from e.g., 260 mm/sec to 400 mm/sec, the rotation number of the drive motor results in 1.5 times. It is therefore extremely difficult to change the paper transfer speed by the method using the drive motor.

Furthermore, in the method of using the electro-magnetic clutches, one of the electromagnetic clutches is always left unused, with the result that the cost increases.

BRIEF SUMMARY OF THE INVENTION

The present invention has been made in view of the aforementioned circumstances. An object of the present invention is to provide a mounting device for an image forming apparatus capable of changing a feed speed of a medium in a simple structure in place of exchanging a drive gear, controlling the rotation number of the drive motor, and using an electromagnetic clutch.

A mounting device for an image forming apparatus according to the present invention comprises a mounting rack for mounting an image forming apparatus for forming an image at a predetermined speed;

feeding means provided within the mounting rack for feeding a medium into the image forming apparatus; and changing means for changing a medium feeding speed of the feeding means in accordance with an image forming speed of the image forming apparatus, the changing means comprising a movable gear having coaxially-arranged large and small gear portions different in the number of teeth and rotating upon receipt of driving force; and first and second power transmitting systems for transmitting power to the feeding means when the large and small gear portions are selectively connected by shifting the movable gear, to drive the feeding means at a different speed.

A mounting device of the image forming apparatus according to the present invention comprises:

a mounting rack for mounting an image forming apparatus forming an image at a predetermined speed;

feeding means provided within the mounting rack for feeding a medium into the image forming apparatus; and changing means for changing a medium feeding speed of the feeding means in accordance with an image forming speed of the image forming apparatus, the changing means comprising first and second gears rotating at different speeds upon receipt of driving force; and a movable gear for transmitting power to the feeding means by selectively engaging with the first and second gears, thereby rotating at a different speed.

A mounting device for mounting an image forming apparatus according to the present invention comprises:

a mounting rack for selectively mounting a first image forming apparatus forming an image at a first speed and having a first output gear capable of being driven and rotated at a speed corresponding to the first speed or a second image forming apparatus forming an image at a second speed, which differs from the first speed, and having a second output gear capable of being driven and rotated at a speed corresponding to the second speed;

feeding means provided within the mounting rack, for feeding a medium into the first or the second image forming apparatus;

first power transmitting means provided within the mounting rack and having a first input gear to which the first output gear is connected when the first image forming apparatus is mounted, for transmitting power to the feeding means; and second power transmitting means provided within the mounting rack and having a second input gear to which the first output gear is connected when the second image forming apparatus is mounted, for transmitting power to the feeding means.

DETAILED DESCRIPTION OF THE INVENTION

Figure 1:
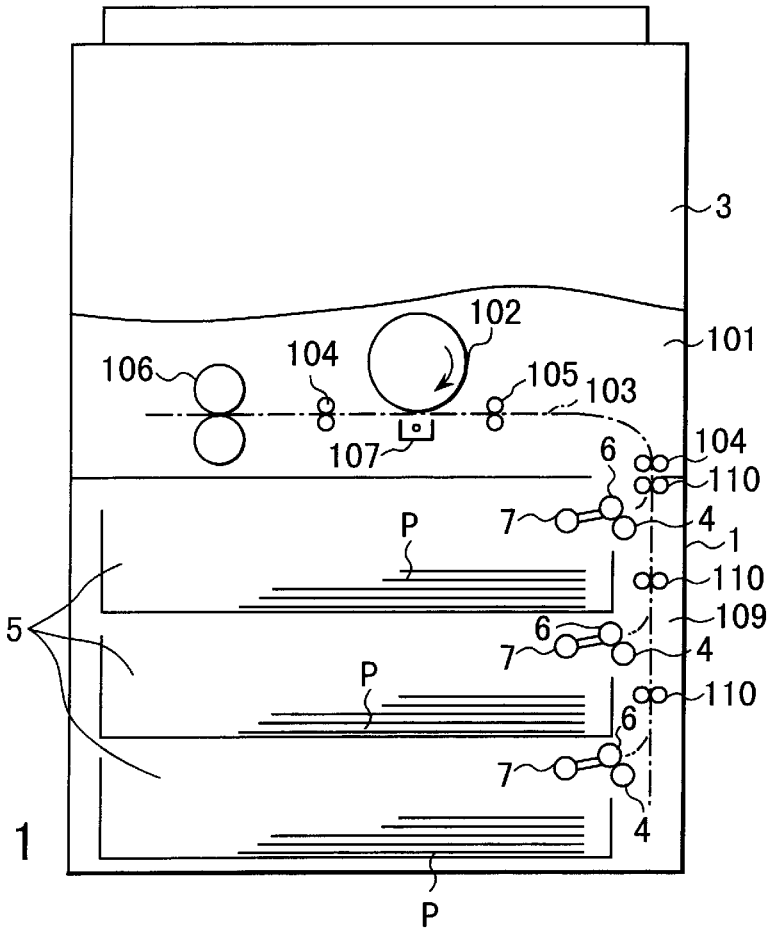
FIG. 1 is a schematic view showing a structure of a copying machine and a paper feed rack according to a first embodiment of the present invention.

Now, the present invention will be explained with reference to embodiments shown in the drawings.

Figure 2:
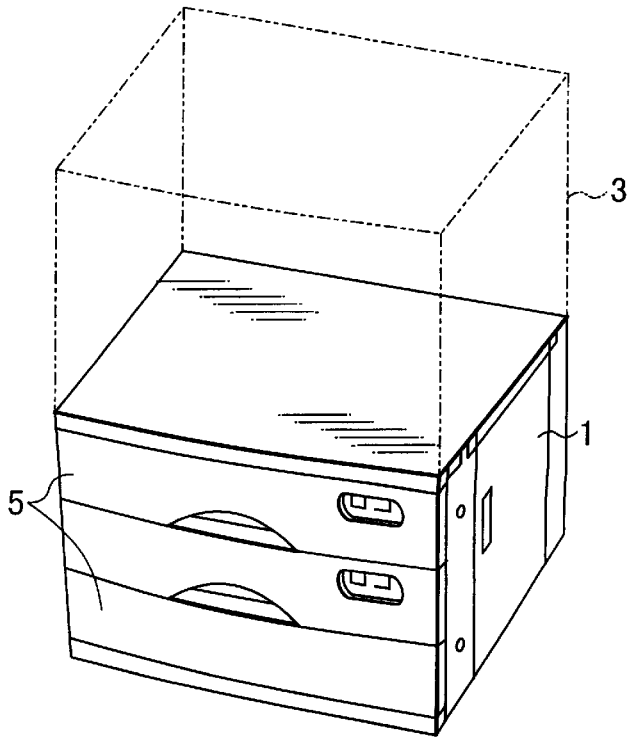
FIG. 2 is a perspective view of the paper feed rack.

FIG. 1 is a schematic view showing a structure of a paper feed rack 1 as a mounting device according to a first embodiment of the present invention, and an electrographic copying machine 3 as an image forming apparatus mounted on the paper feed rack 1. FIG. 2 is a perspective view showing the paper feed rack 1.

The electrographic copying machine 3 has a machine main body 101. In the machine main body 101, a photosensitive drum 102 is rotatably provided. At a lower side of the photosensitive drum 102, a transfer charger 107 is provided. On the photosensitive drum 102, a toner image corresponding to an image of an original document is formed by an image forming mechanism (not shown).

In the machine main body 101, a transfer path 103 is arranged for passing a paper sheet through the lower side of the photosensitive drum 102. Along the transfer path 103, arranged are a transfer roller pair 104 for transferring a paper sheet at a predetermined speed and a resist roller pair 105 for aligning the paper sheet to be sent to the photosensitive drum 102. Furthermore, a fixing unit 106 is provided at a downstream side of the transfer path 103, for fixing the toner image transferred onto the paper sheet. The transfer roller pair 104 is rotatably driven at a predetermined speed by the driving mechanism (not shown).

On the other hand, within the paper feed rack 1, paper cassettes 5 are arranged in a plurality of stages. In the cassettes 5, paper sheets P are stored as a medium. On the upper side of each of the paper cassette 5, provided are a pick up roller 7 for picking up the paper sheets P a paper feed roller 6 and a separation roller 4 serving as a feeding means for separating the picked up paper sheets one by one and feeding it.

Within the paper feed rack 1, a vertical transfer path 109 connecting to the aforementioned transfer path 103 is arranged. In the vertical transfer path 109, a transfer roller pair 110 is arranged for sandwiching and transferring the supplied paper sheet.

The paper feed roller 6 and the transfer roller pair 110 are rotated at a copying speed, in other words, a speed in accordance with a rotation speed of the transfer roller pair 104, by the driving mechanism according to the present invention later described.

When an image is formed, the toner image corresponding to an image of an original document is formed on the photosensitive drum 102 by an image forming mechanism (not shown). On the other hand, the paper sheets P are picked up from the paper feed cassette 5 by the pick-up roller 7, separated one by one by the paper feed roller 6 and the separation roller 4 and sent out to the vertical transfer path 109. The paper sheet P thus sent out is transferred by the transfer roller pair 110 while being sandwiched and then sent to the transfer path 103 of the copying machine main body 101. The paper sheet P sent to the transfer path 103 is transferred by the transfer roller pair 104 and aligned by the resist roller pair 105, and thereafter, sent to an image transfer section between the photosensitive drum 102 and the transfer unit 107. In the image transfer section, the toner image on the photosensitive drum 102 is transferred onto the paper P. The paper sheet P having the toner image transferred thereon is sent to the fixing unit 106 to fix the toner image onto the paper sheet P. The paper sheet P having the toner image fixed thereon is discharged to a paper discharge section (not shown).

Figure 3:
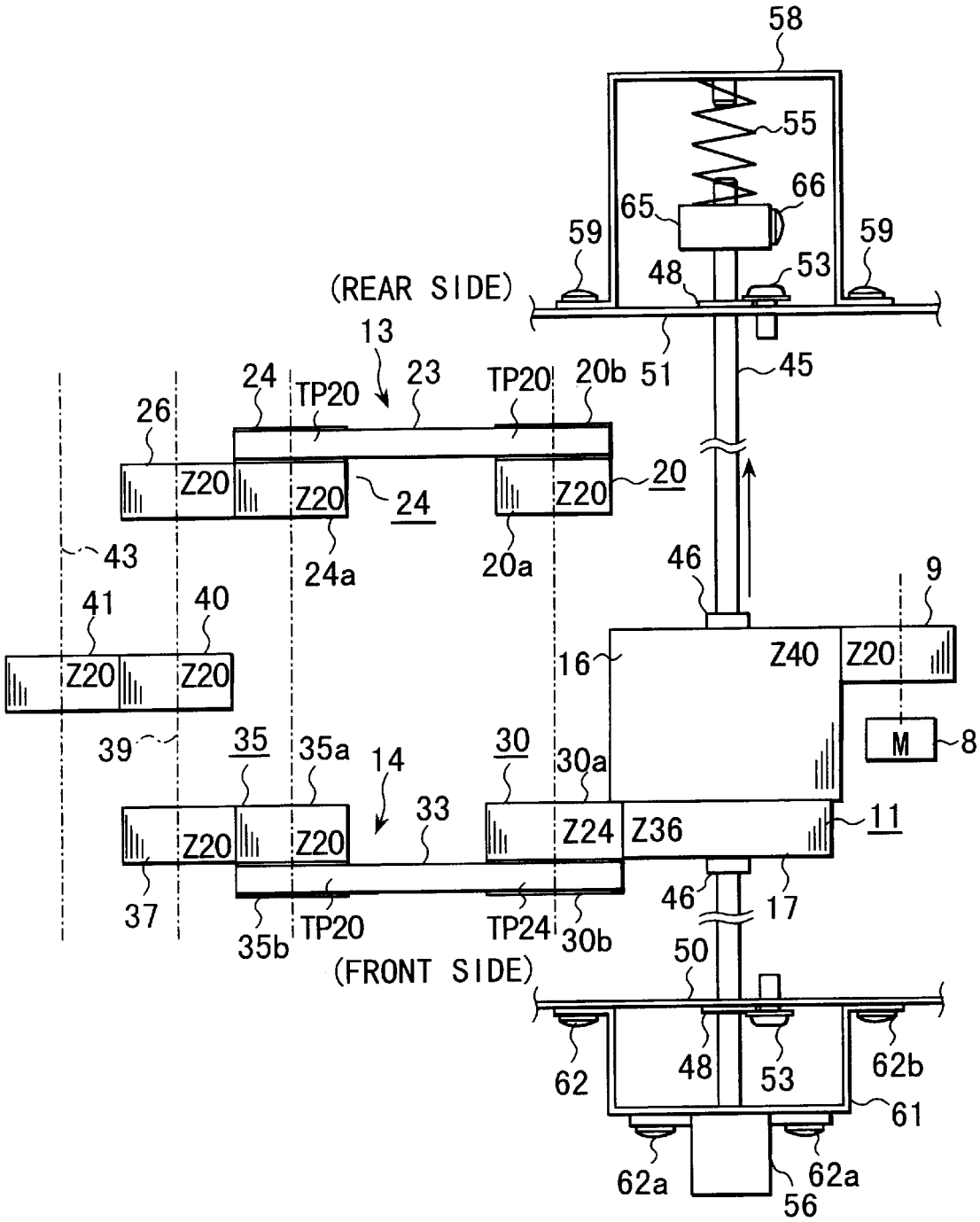
FIG. 3 is a plan view of a driving system of the paper feed rack.

FIG. 3 shows a driving system for rotatably driving the paper feed roller 6.

In the figure, reference numeral 8 indicates a drive motor, to which a drive gear 9 is connected.

To the drive gear 9, first and second power transmitting systems 13, 14 are selectively connected via a switch gear 11 as a movable gear. The switch gear 11 is a stepped gear having a coaxially arranged large gear portion 16 and a small gear portion 17 different in the number of teeth.

The first power transmitting system 13 has a first rotation body 20 consisting of a gear portion 20*a* and a pulley portion 20*b*, and a second rotation body 24 consisting of a gear portion 24*a* and a pulley portion 24*b*. A timing belt 23 is stretched between the pulley portion 20*b* and the pulley portion 24*b* of the first and second rotation bodies 20, 24. The gear portion 24*a* of the second rotation body 24 is engaged with a follower gear 26.

The second power transmitting system 14 has a third rotation body 30 consisting of a gear portion 30*a* and a pulley portion 30*b* and a fourth rotation body 35 consisting of a gear portion 35*a* and a pulley portion 35*b*. A timing belt 33 is stretched between the pulley portion 30*b* and the pulley portion 35*b* of the first and second rotation bodies 30, 35. A gear portion 35*a* of the fourth rotation body 35 is engaged with a follower gear 37.

To the follower gear 26 of the first power transmitting system 13 and the follower gear 37 of the second power transmitting system 14, an output gear 41 is connected by way of a shaft 39 and a gear 40. To the output gear 41, the paper feed roller 6 and the transfer roller 110 are connected by way of a power transmitting member 43.

On the other hand, the stepped gear 11 is attached to a shaft 45 via stop rings 46, 46. Both ends of the shaft 45 are held by bearings 48, 48. The bearings 48, 48 are attached to a front frame 50 and a rear frame 51 with a collar screw 53. A rear side portion of the shaft 45 is always pressed toward a front side thereof by a compression coil spring 55.

A spring switch 56 is attached to the end portion of the shaft 45 at the front side. The spring switch 56 is pressed from the front side, whereby the stepped gear 11 is slid integrally with the shaft 45 in a direction from the front to the rear and then rocked. The compression coil spring 55 is attached to a bracket 58. The bracket 58 is fixed onto the rear frame 51 with a screw 59. The spring switch 56 is fixed onto a bracket 61 with a screw 62*a*. The bracket 61 is fixed at a front frame 50 with a screw 62*b*.

Note that a flange 65 is fixed to an end portion of the shaft 45 at the rear side with a fixing screw 66. The flange 65 is pressed toward a front direction with a coil screw 55.

Now, we will explain the case where a copying machine making copies at a normal copying speed is placed on the paper feed rack 1 constituted as mentioned above.

In this case, the shaft 45 is pressed toward the front side by use of urging force of the spring 55 without pressing the switch 56 by hand, whereby a small gear portion 17 of the stepped gear 11 comes to be engaged with the gear portion 30*a* of the third rotation body 30 of the second power transmitting system 14. Operation of the drive motor 8 is initiated from this state. When the drive motor 8 is driven, the drive gear 9 is rotated. With the rotation of the drive gear 9, the stepped gear 11 is rotated. In accordance with the rotation of the stepped gear 11, the third rotation body 30 of the second power transmitting system 14 is rotated. Since the third rotation body 30 is rotated by the rotation of the small gear portion 17 having a smaller number of teeth, it is rotated at a normal speed. With this rotation, the fourth rotation body 35 is rotated through the belt 33. Then, power is transmitted to the paper feed roller 6 and transfer roller pair 110 by way of the follower gear 37, shaft 39, gear 40, output gear 41, and power transmitting member 43. By the power thus transmitted, the paper P is fed at a normal speed, in other words, the speed corresponding to a normal copying speed of the electrophotographic copying machine.

Next, we will explain the case where an electrophotographic copying machine making copies at a high copying speed is mounted on the paper feed rack 1.

Figure 4:
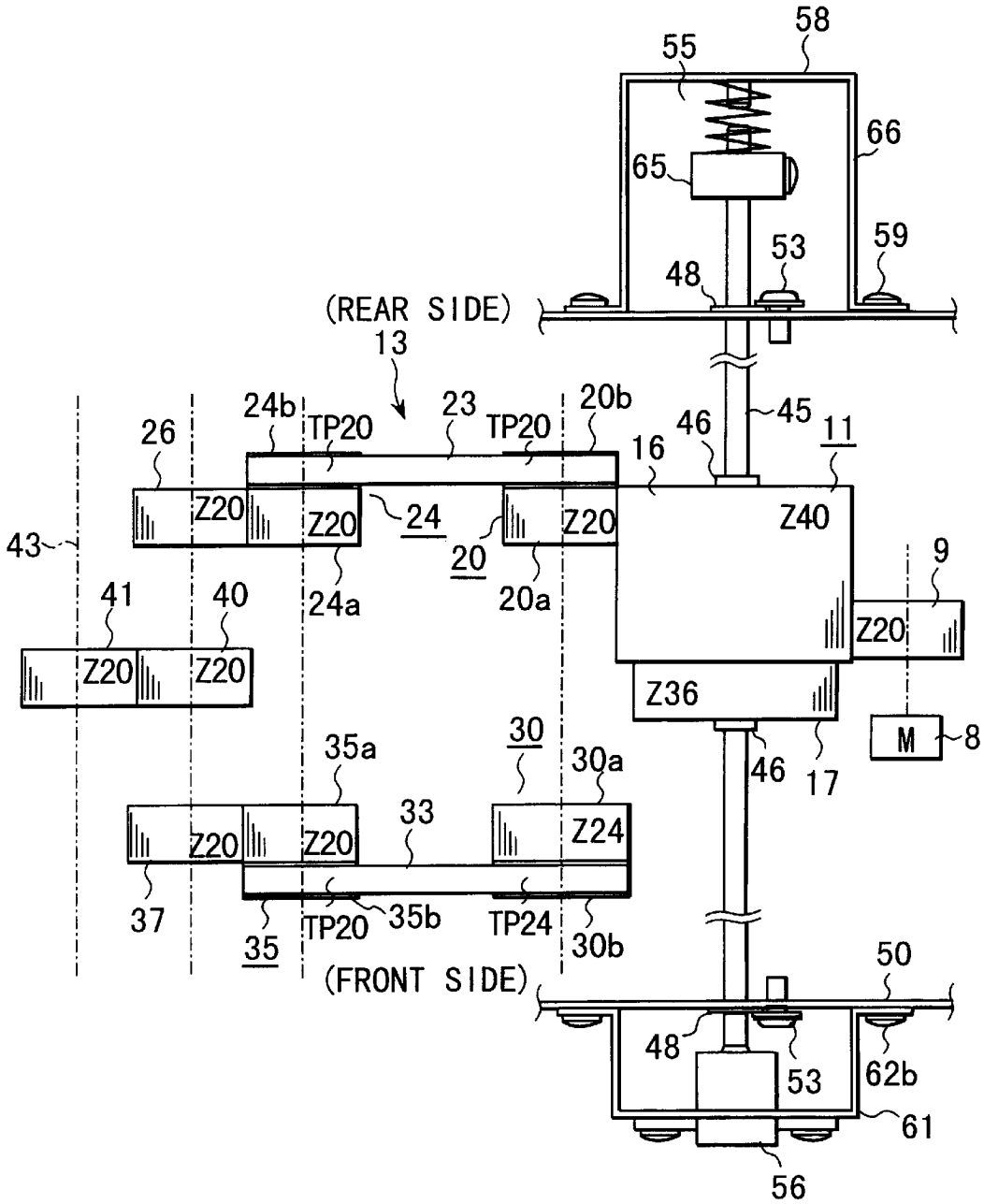
FIG. 4 is a view showing a switching operation of the driving system.

In this case, an operator presses the spring switch 56. Then, the shaft 45 moves toward the rear side against the urging force of the spring 55, as shown in FIG. 4. In accordance with this movement, the stepped screw 11 is detached from the gear portion 30*a* of the third rotation body 30 to connect the large gear portion 16 to the gear portion 20*a* of the first rotation body 20 of the first power transmitting system 13. At that time, the stepped screw 11 is still engaged with the drive gear 9. From this state, the drive motor 8 is rotationally driven to rotate the stepped gear 11 by way of the drive gear 9. When the stepped gear 11 is rotated, the first rotation body 20 of the first power transmitting system 13 is rotated. Since the first rotation body 20 is rotated by the rotation of the large gear portion 16 having a large number of teeth, it is rotated at a high speed. This rotation is transmitted through the belt 23 to rotate the second rotation body 24. With this rotation, power is transmitted to the paper feed roller 6 and the transfer roller pair 110 by way of the follower gear 26, shaft 39, follower gear 40, output gear 41 and power transmitting member 43. Since power is transmitted in this manner, the paper P is fed at the speed corresponding to the high copying speed within the elecrophotographic copying machine.

According to this embodiment, it is possible to easily change a paper feed speed in accordance with the copying speed of the electrophotographic copying machine simply by pressing the spring switch 56.

Figure 5:
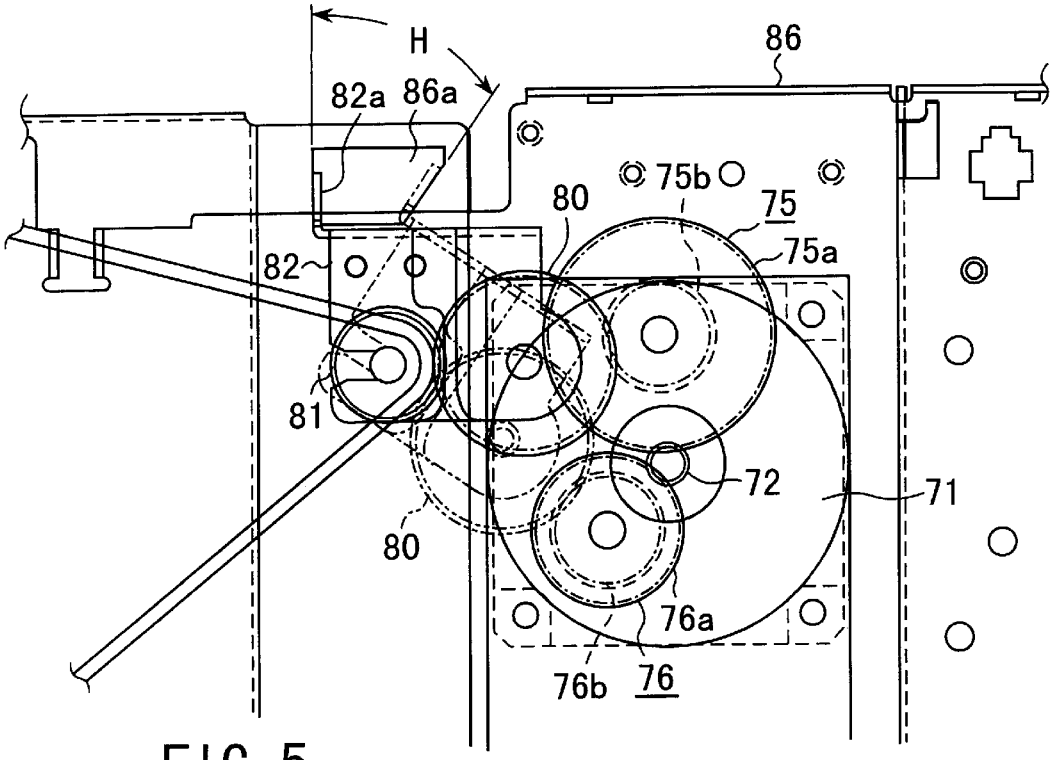
FIG. 5 is a front view showing a driving system of the paper feed rack according to a second embodiment.
Figure 6:
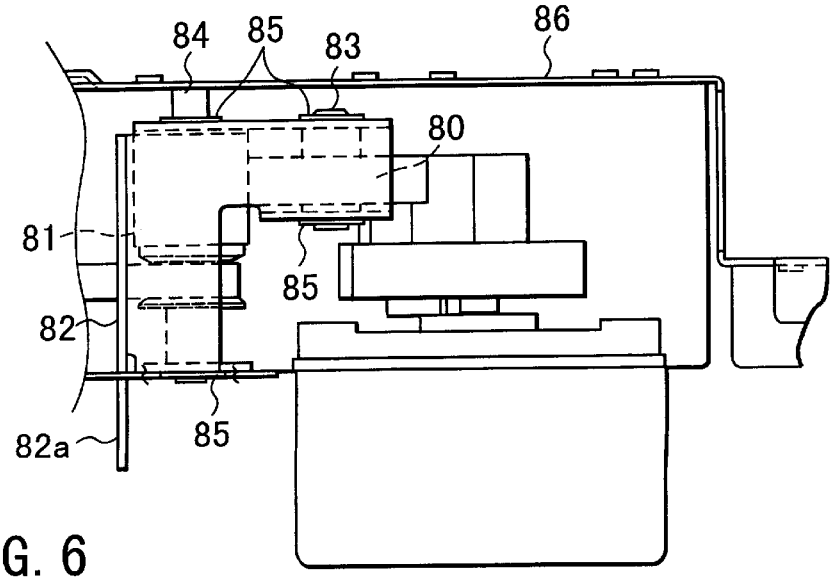
FIG. 6 is a plan view showing the driving system according to the second embodiment.

FIG. 5 shows a driving system of the paper feed roller 6 according to a second embodiment.

In the figure, reference numeral 71 is a drive motor. To a shaft 71*a* of the drive motor 71, a drive gear 72 is connected. With the drive gear 72, first and second stepped gears 75, 76 are engaged.

The first stepped gear 75 has a large gear portion 75*a* and a small gear portion 75*b* coaxially arranged. The large gear portion 75*a* is engaged with the drive gear 72. The second stepped gear 76 has a large gear portion 76*a* and a small gear portion 76*b* coaxially arranged. The large gear portion 76*a* is engaged with the drive gear 72. The large gear portion 75*a* of the first stepped gear 75 has a larger diameter and thus has a larger number of teeth than the large gear portion 76*a* of the second stepped gear 76.

With the small gears 75*a* and 75*b* of the first and second stepped gears 75 and 76, a planet gear 80 as a movable gear is selectively engaged. With the planet gear 80, a gear 81 is engaged. The planet gear 80 moves around the gear 81.

The planet gear 80 and the gear 81 are attached to the bracket 82 serving as a rotation member via the shafts 83, 84. To the shafts 83, 84, an E-shape retaining ring 85 is attached for aligning both end portions of the planet gear 80 and the gear 81. The shaft 84 is fixed onto the frame 86. The bracket 82 moves around the shaft 84.

The bracket 82 has a projecting portion 82*a* formed thereon. The projecting portion 82*a* is engaged in a window 86*a* of the frame 86. By virtue of this structure, the bracket 82 and the planet gear 80 are integrally rotated using a center of the gear 81 as a fulcrum within the range H indicated in the figure.

Now, we will explain the case where a copying machine making copies at a normal copying speed, in other words, a copying machine in which paper sheets are fed at a normal speed, is mounted on the paper feed rack 1 constituted as mentioned in the above.

Figure 7:
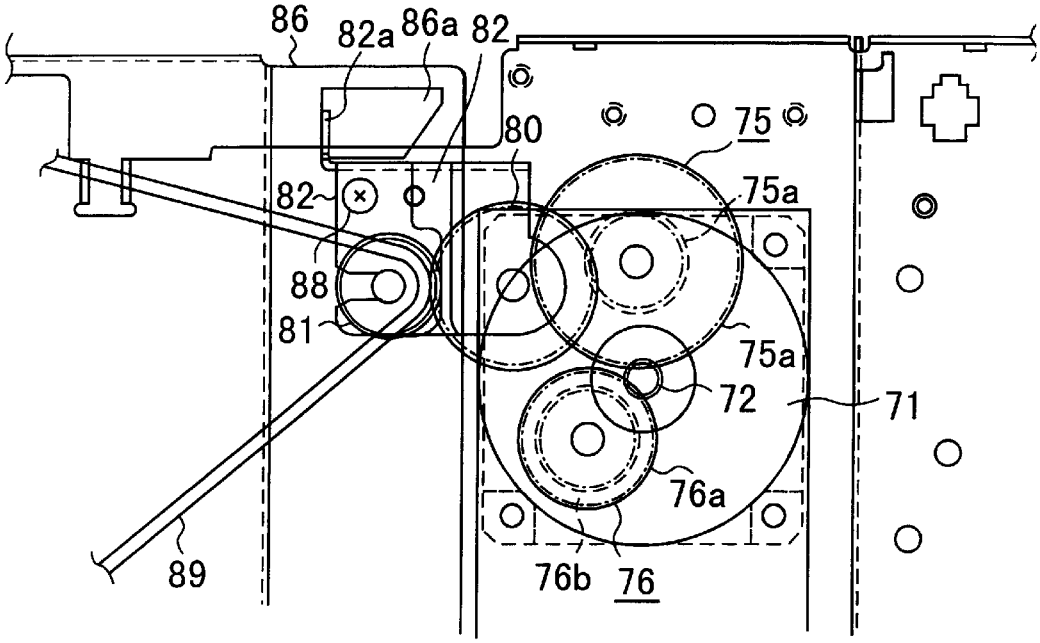
FIG. 7 is a view showing a switching operation of the driving system.

In the case, as shown in FIG. 7, the bracket 82 is rotated horizontally and fixed onto the frame 86 with a screw 88 serving as a fixing means to thereby allow the planet gear 80 to be engaged with a small gear portion 75*b* of the first stepped gear 75. From this state, the drive motor 71 is driven to rotate a first stepped gear 75 via the drive gear 72. With this rotation, the gear 81 is rotated via the planet gear 80. The driving belt 89 is moved in accordance with the rotation to rotate the paper feed roller 6 and the transfer roller pair, so that a paper sheet is supplied at the normal speed corresponding to the paper transfer speed of the copying machine.

Next, we will explain the case where a copying machine making copies at a high speed, in other words, a copying machine in which paper sheets are fed at a high speed is mounted on the paper feed rack 1.

Figure 8:
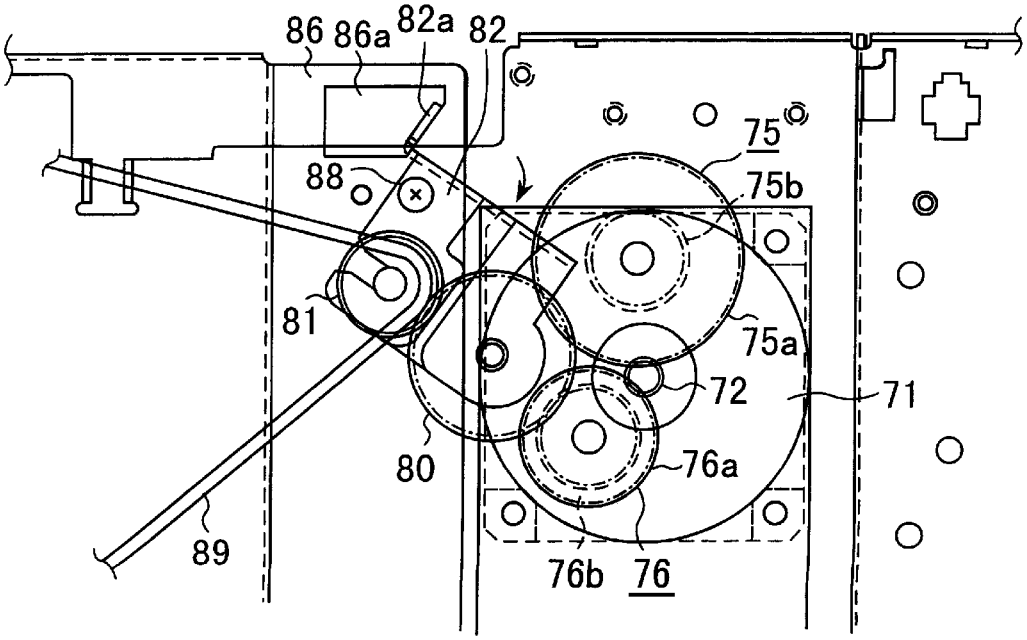
FIG. 8 is a view showing a switching operation of the driving system.

In this case, at a customer site, a service technician removes a rear cover of the paper feed rack 1 and loosens the fixing screw 88 to rotate the bracket 82 downward as shown in FIG. 8. By this operation, the planet gear 80 is allowed to engage with the small gear portion 76*b* of the second stepped gear 76. Thereafter, the fixing screw 88 is tightened again to fix the bracket 82 onto the frame 86.

From this state, the drive motor 71 is started to rotate the second stepped gear 76 via the drive gear 72. With this rotation, the gear 81 is rotated by way of the planet gear 80. Since the second stepped gear 76 is smaller in axle ratio than the first stepped gear 75, the planet gear 80 is engaged with the second stepped gear 76. As a result, the planet gear 80 rotates at a high speed. Subsequently, the paper feed roller 6 and the transfer roller pair 110 are rotated by way of the driving belt 89 to feed the paper sheets at the high speed corresponding to the paper transfer speed of the copying machine.

According to this embodiment, it is possible for a service technician to change the paper feed speed of the paper feed rack 1 simply by removing a rear cover of the paper feed rack 1 and rotating the bracket 82 at a customer site.

Figure 9:
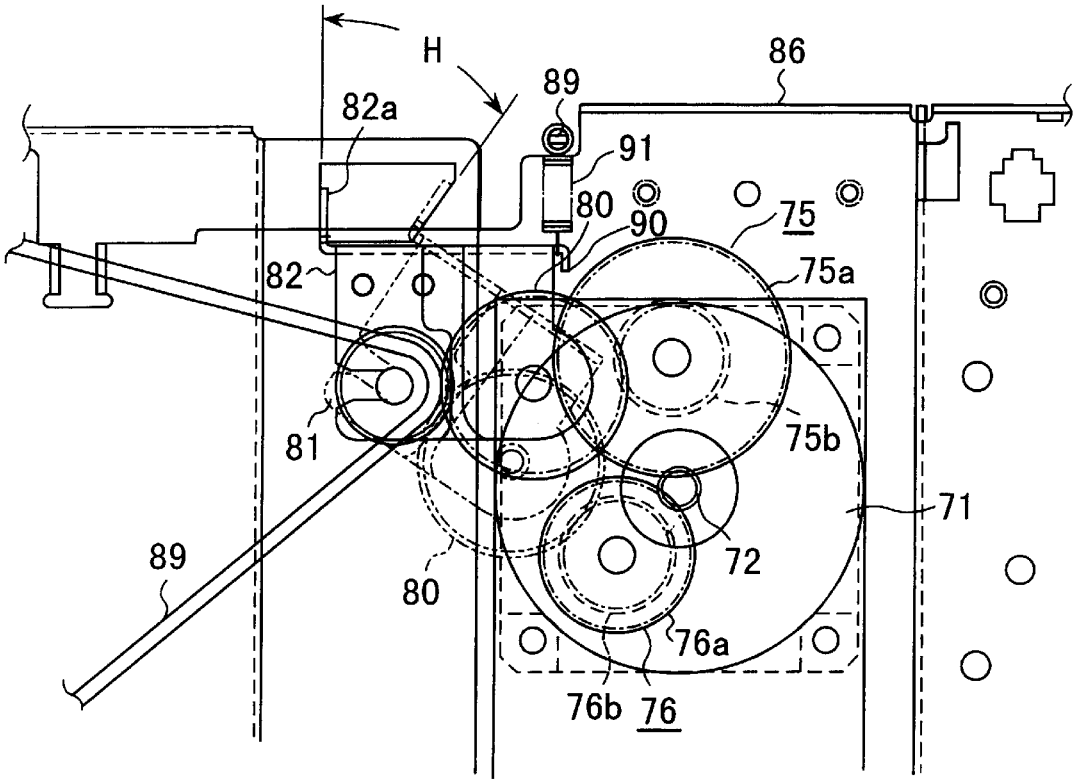
FIG. 9 is a front view of a driving system of a paper feed rack according to a third embodiment.
Figure 10:
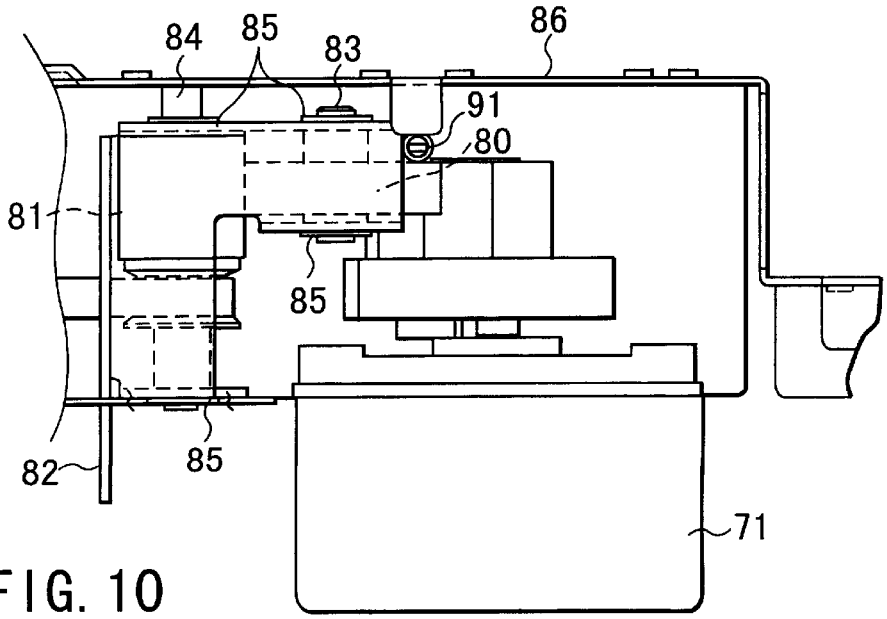
FIG. 10 is a plan view of the driving system according to the third embodiment.

FIG. 9 and FIG. 10 shows a driving system of the paper feed roller 6 according to a third embodiment of the present invention. Like reference numerals are used to designate like structural elements corresponding to those in the second embodiment and any further explanation is omitted for brevity's sake.

In this embodiment, the bracket 82 is elastically urged upward by a spring 91 as an urging member. The frame 86 and the bracket 82 have hook portions 89, 90, respectively. The spring 91 is stretched between the hook portions 89 and 90.

Figure 12:
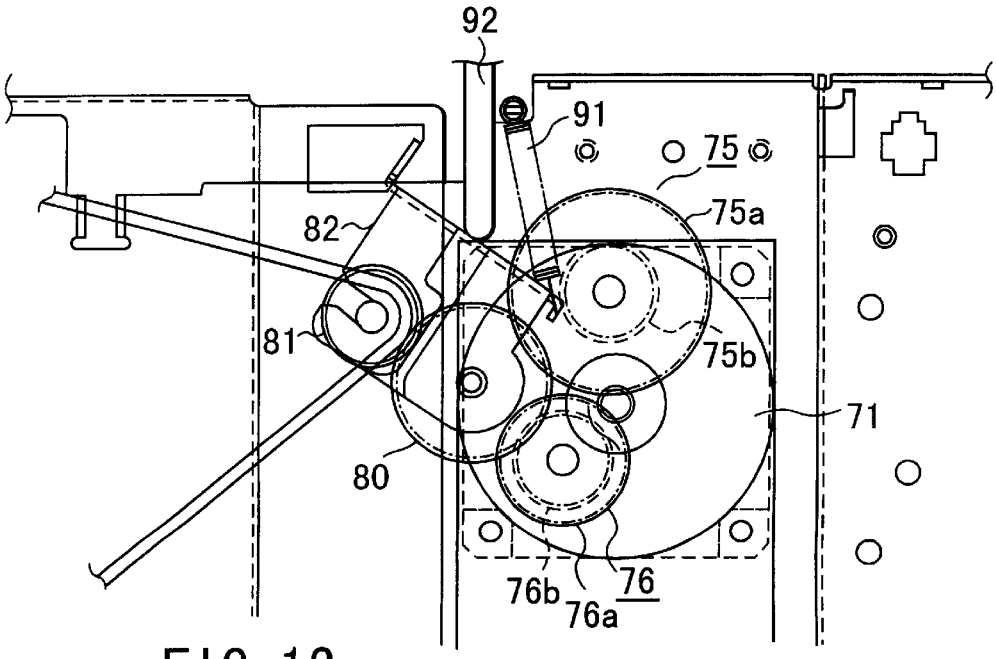
FIG. 12 is a view showing a switching operation of the driving system.

In this embodiment, a projecting portion 92 projecting downward is provided at a bottom portion of the copying machine main body 101 making copies at a high speed, as shown in FIG. 12.

The aforementioned projecting portion is not provided in the copying machine operated at a normal copying speed.

Now, we will explain the case where the copying machine making copies at a normal speed is mounted on the paper feed rack 1.

Figure 11:
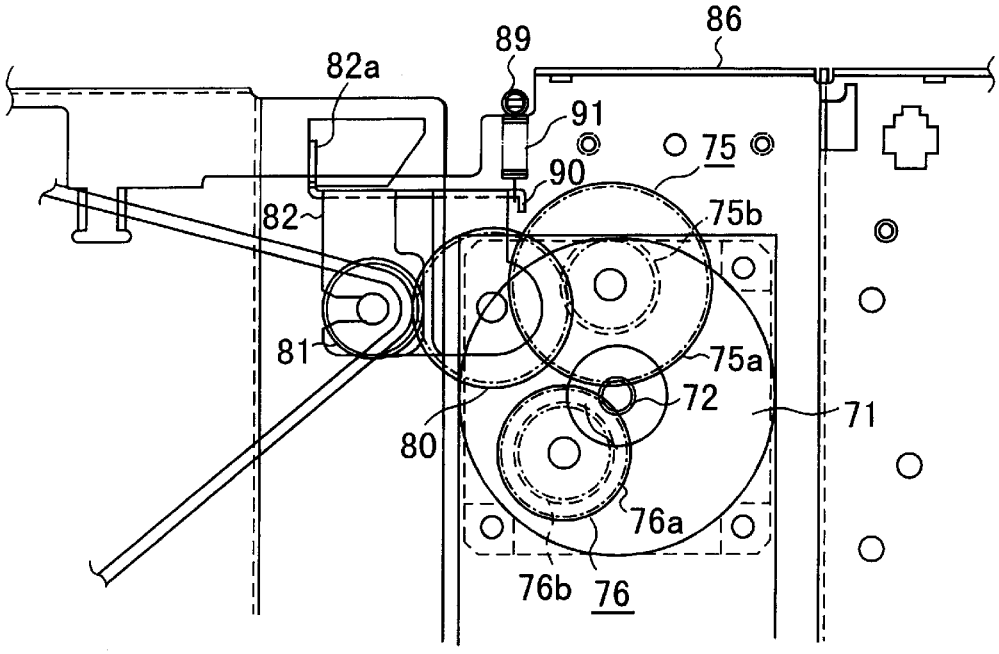
FIG. 11 is a view showing a switching operation of the driving system.

In this case, when the copying machine is mounted, the bracket 82 is rotated upward by the urging force of the spring 91 to keep a horizontal posture, as shown in FIG. 11. With this mechanism, the planet gear 80 is engaged with the small gear portion 75*b* of the first stepped gear 75.

Therefore, when the drive motor 71 is driven, the power transmitting gear 81 is rotated by way of the drive gear 72, the first stepped gear 75, and the planet gear 80. The paper feed roller 6 is rotated by the rotation of the power transmitting gear 81 to feed the paper sheets at the normal speed corresponding to the high copying speed of the copying machine.

Next, we will explain the case where the high-speed copying machine is mounted on the paper feed rack 1.

In this case, when the copying machine is mounted, the machine presses the upper portion of the projecting portion 92 projecting from the bottom portion of the copying machine main body 101, as shown in FIG. 12. Subsequently, the bracket 82 rotates downward against the urging force of the spring 91 to allow the planet gear 80 to engage with the small gear portion 76*b* of the second stepped gear 76.

Thereafter, when the drive motor 71 is driven, a power transmitting gear 81 is rotated by way of the drive gear 72, the second stepped gear 76 and the planet gear 80. The paper feed roller 6 is rotated at a high speed by the rotation of the power transmitting gear 81, with the result that paper sheets are fed at the high speed according to the copying speed of the copying machine.

According to this embodiment, it is not necessary to operate the spring switch 56 and to remove the cover, as performed in the first and second embodiments. In addition, a paper feed speed can be changed in accordance with the copying speed simply by mounting the copying machine main body 101 on the paper feed rack 1. Therefore, time and labor are saved.

Figure 13:
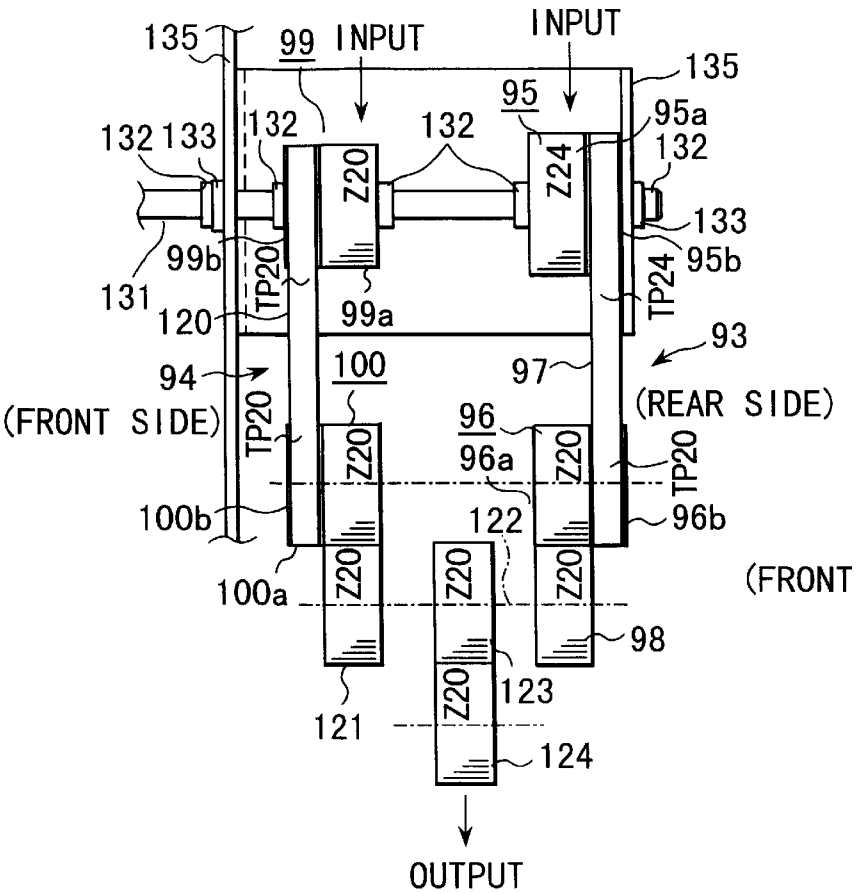
FIG. 13 is a front view showing a driving system of a paper feed rack according to a fourth embodiment.

FIG. 13 shows the driving system of the paper feed roller 6 according to a fourth embodiment of the present invention.

Figure 14:
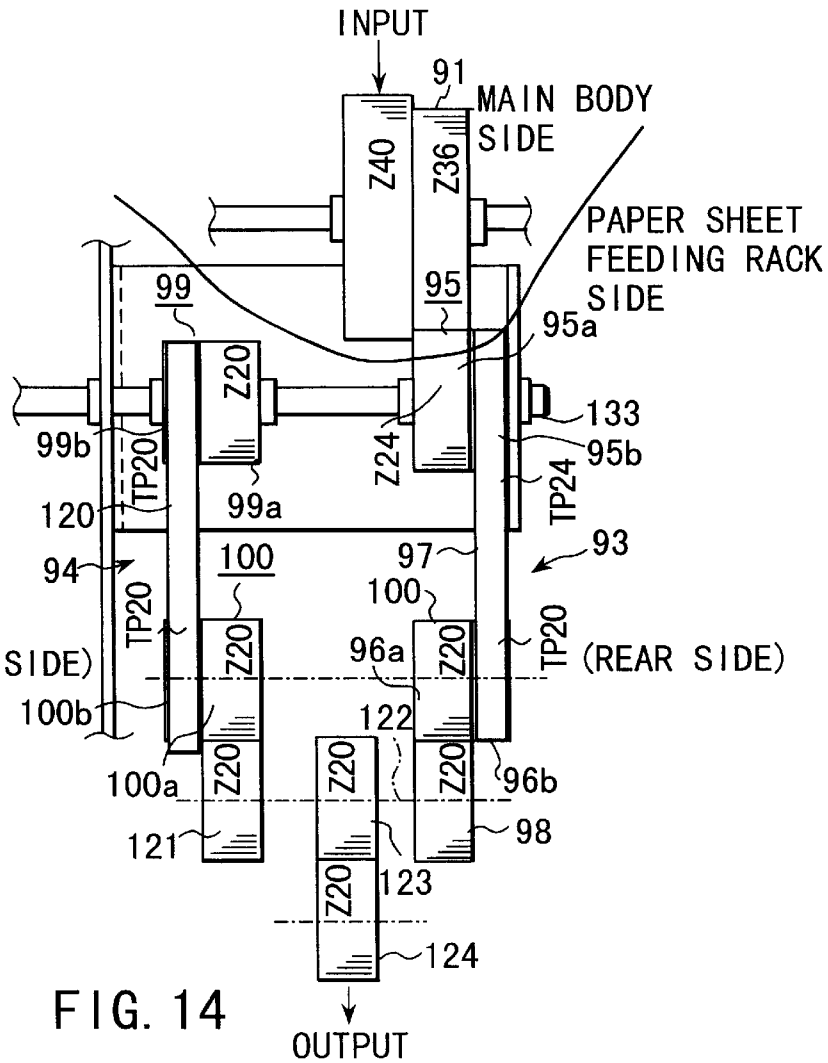
FIG. 14 is a view showing how to connect a driving system and a first input gear.

In this embodiment, an output gear 91 is provided at the rear side so as to project downward from the bottom portion of the copying machine main body 101 in which copies are made at a normal speed, as shown in FIG. 14.

The output gear 91 is rotated at the same speed as the paper sheet transferring speed by a driving mechanism of the paper transferring system in the copying machine.

Furthermore, an output gear 92 is provided at the front side so as to project downward from the bottom portion of the copying machine in which copies are made at a high speed, that is, paper sheets are fed at a high speed. The output gear 92 is rotated at a speed as high as the paper transferring speed by the driving mechanism of the paper transfer system in the copying machine.

On the other hand, the first and second power transmitting systems 93, 94 are arranged within the paper feed rack 1.

The first power transmitting system 93 has a first rotation body 95 consisting of a gear portion 95*a* and a pulley portion 95*b*, and a second rotation body 96 consisting of a gear portion 96*a* and a pulley portion 96*b*. A timing belt 97 is stretched between the pulley portions 95*b* and 96*b* of the first and second rotation bodies 95 and 96. The follower gear 98 is engaged with the gear portion 96*a* of the second rotation body 96.

The second power transmitting system 94 has a third rotation body 99 consisting of a gear portion 99*a* as a second input gear and a pulley portion 99*b*, and a fourth rotation body 100 consisting of a gear portion 100*a* and a pulley portion 100*b*. A timing belt 120 is stretched between the pulley portions 99*b* and 100*b* of the third and fourth rotation bodies 99, 100. The gear portion 100*a* of the fourth rotation body 100 is engaged with a follower gear 121.

To the follower gear 98 of the first power transmitting system 93 and the follower gear 121 of the second power transmitting system 94, a shaft 122 and an output gear 124 are connected via a gear 123. A paper feed roller 6 and the transfer roller 110 are connected to the output gear 124 via a power transmitting member (not shown).

Furthermore, the first rotation body 95 and the second rotation body 99 are attached to a shaft 131. Both ends of the shaft are stopped by stop rings 132. Both end portions of the shaft 131 are held by frames 135, 135 via bearing portions 133, 133.

Next, we will explain the case where the copying machine making copies at a normal speed is placed on the paper feed card 1.

In this case, when the copying machine is mounted on the paper feed rack, the output gear 91 projecting from the bottom portion of the main body is engaged with a joint gear portion 99*a* of the third rotation body 99 of the second power transmitting system 94 in the paper feed rack 1, as shown in FIG. 14.

When the copying machine is driven and the output gear 91 is rotated, the joint gear portion 99*a* of the third rotation body of the second power transmitting system 94 is rotated, and subsequently, the fourth rotation body 100 is rotated by way of the belt 120. With this rotation, the output gear 124 is rotated by way of the follower gear 121 and the gear 123, whereby the paper feed roller 6 is rotated to feed the paper sheets at the normal speed.

Now, we will explain the case where the copying machine making copies at a high speed is mounted on the paper feed rack 1.

Figure 15:
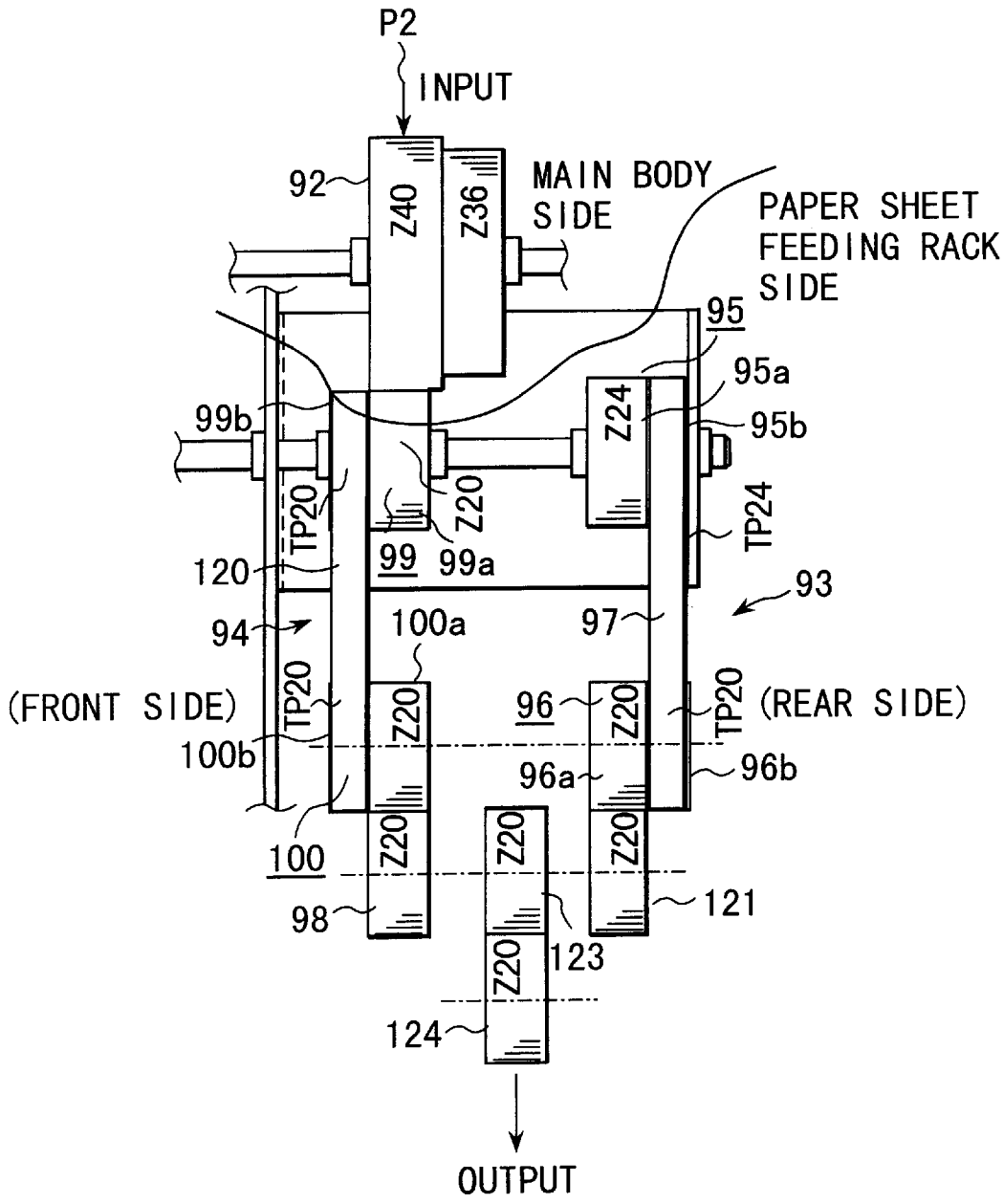
FIG. 15 is a view showing how to connect a driving system and a second input gear.

In this case, when the copying machine is mounted on the paper feed rack 1, the output gear 91 projecting form the bottom of the main body is engaged with the joint gear portion 95*a* of the first rotation body 95 of the first power transmitting system 93 in the paper feed rack 1, as shown in FIG. 15.

When the copying machine is driven and subsequently the output gear 92 is rotated, the joint gear portion 95*a* of the first power transmitting system 93 is rotated. Accordingly, the second rotation body 96 is rotated by way of the belt 97. With this rotation, the output gear 124 is rotated by way of the follower gear 98 and the gear 123. As a result, the paper feed roller 6 is rotated to feed the paper sheets at the high speed.

According to the fourth embodiment, the driving force for feeding paper sheets is given by the copying machine mounted on the paper feed rack 1. Therefore, it is not necessary to particularly provide a driving source such as a motor in the paper feed rack 1, whereby the cost can be reduced.

As described in the above, according to the present invention, the paper feed speed can be changed without exploding the driving section. Therefore, time and labor are saved.

Furthermore, the paper feed speed can be changed without using an expensive drive motor and electro-magnetic clutch responsible for changing a rotation speed. It is therefore possible to reduce the cost.

What is claimed is:

1. A mounting device for an image forming apparatus comprising:

a mounting rack for mounting an image forming apparatus for forming an image at a predetermined speed;

feeding means provided within the mounting rack for feeding a medium into the image forming apparatus; and changing means for changing a medium feeding speed of the feeding means in accordance with an image forming speed of the image forming apparatus, the changing means comprising a movable gear having coaxially-arranged large and small gear portions different in the number of teeth and rotating upon receipt of driving force; and first and second power transmitting systems for transmitting power to the feeding means when the large and small gear portions are selectively connected by shifting the movable gear, to drive the feeding means at a different speed.

2. The mounting device of the image forming apparatus according to claim 1, wherein the movable gear is attached to a slidable shaft for selectively connecting the first and second gear portions to the first and second power transmitting system by sliding the shaft in a back and forth direction.

3. A mounting device for an image forming apparatus comprising:

a mounting rack for mounting an image forming apparatus forming an image at a predetermined speed;

feeding means provided within the mounting rack for feeding a medium into the image forming apparatus; and changing means for changing a medium feeding speed of the feeding means in accordance with an image forming speed of the image forming apparatus, the changing means comprising first and second gears rotating at different speeds upon receipt of driving force; and a movable gear for transmitting power to the feeding means by selectively engaging with the first and second gears, thereby rotating at a different speed.

4. The mounting device for an image forming apparatus according to claim 3, wherein the movable gear is attached to a rotating member and the rotating member is selectively engaged with the first and second gear by rotating in back and forth direction.

5. The mounting device for an image forming apparatus according to claim 3, wherein the rotating member is fixed with a fixing tool and rotated by loosening the fixing tool to engage the movable gear with the first or second gear and then fixed again with the fixing tool.

6. The mounting device for an image forming apparatus according to claim 4, wherein the mounting rack is used for selectively mounting a first image forming apparatus for forming an image at a first speed and a second image forming apparatus which forms an image at a second speed, which differs from the first speed, and which has a projecting portion projecting downward from a bottom thereof; and the rotating member is urged by an urging member and rotated in a first direction to allow the movable gear with the first gear when the first image forming apparatus is mounted, and rotated in a second direction, which is opposite to the first direction, by means of a projecting portion projecting downward from the bottom, against an urging force given by the urging member, with the result that the movable gear is engaged with a second gear when the second image forming apparatus is mounted.

7. A mounting device for mounting an image forming apparatus comprising:

a mounting rack for selectively mounting a first image forming apparatus forming an image at a first speed and having a first output gear capable of being driven and rotated at a speed corresponding to the first speed and a second image forming apparatus forming an image at a second speed, which differs from the first speed, and having a second output gear capable of being driven and rotated at a speed corresponding to the second speed;

feeding means provided within the mounting rack, for feeding a medium into the first or the second image forming apparatus;

first power transmitting means provided within the mounting rack and having a first input gear to which the first output gear is connected when the first image forming apparatus is mounted, for transmitting power to the feeding means; and second power transmitting means provided within the mounting rack and having a second input gear to which the first output gear is connected when the second image forming apparatus is mounted, for transmitting power to the feeding means.

* * * * *